US010060659B2

(12) United States Patent
Thawani et al.

(10) Patent No.: US 10,060,659 B2
(45) Date of Patent: Aug. 28, 2018

(54) NOISE REDUCTION INSERT FOR AN EVAPORATOR

(71) Applicant: DENSO International America, Inc., Southfield, MI (US)

(72) Inventors: Prakash Thawani, Bloomfield Hills, MI (US); Stephen Sinadinos, Commerce Township, MI (US); Derrick Scott, Eastpointe, MI (US); Anthony Faulkner, Southfield, MI (US); Hiroyuki Hayashi, Kariya (JP)

(73) Assignee: DENSO International America, Inc., Southfield, MI (US)

( * ) Notice: Subject to any disclaimer, the term of this patent is extended or adjusted under 35 U.S.C. 154(b) by 92 days.

(21) Appl. No.: 15/000,653

(22) Filed: Jan. 19, 2016

(65) Prior Publication Data

US 2016/0265823 A1 Sep. 15, 2016

Related U.S. Application Data

(60) Provisional application No. 62/132,557, filed on Mar. 13, 2015.

(51) Int. Cl.
*F25B 39/02* (2006.01)
*F28D 21/00* (2006.01)

(52) U.S. Cl.
CPC ..... *F25B 39/02* (2013.01); *F25B 2500/12* (2013.01); *F28D 2021/0085* (2013.01); *F28F 2265/28* (2013.01)

(58) Field of Classification Search
CPC .... F25B 39/02; F25B 39/022; F25B 2500/12; F28D 2021/0085; F28F 2265/28
USPC ..... 62/515, 498
See application file for complete search history.

(56) References Cited

U.S. PATENT DOCUMENTS 5,906,225 A 5/1999 Stark et al.
6,810,683 B2 11/2004 Eustice
8,047,449 B2 11/2011 Lou et al.

FOREIGN PATENT DOCUMENTS

JP 11063733 A * 3/1999
JP 2011133139 A 7/2011

* cited by examiner

*Primary Examiner* — Melvin Jones
(74) *Attorney, Agent, or Firm* — Harness, Dickey & Pierce, P.L.C.

(57) ABSTRACT

A noise reduction insert for an evaporator. The noise reduction insert includes a body defining an inner volume of the insert. The body extends along a longitudinal axis of the insert. A perforated portion of the body defines a plurality of openings configured to allow fluid to pass out from within the inner volume through the plurality of openings. A flange at a first end of the body is opposite to a second end of the body. The flange defines an aperture through which the longitudinal axis extends. The aperture is configured to permit fluid to flow therethrough and into the inner volume defined by the body.

18 Claims, 4 Drawing Sheets

NOISE REDUCTION INSERT FOR AN EVAPORATOR

CROSS-REFERENCE TO RELATED APPLICATION

This application claims the benefit of U.S. Provisional Application No. 62/132,557 filed on Mar. 13, 2015, the entire disclosure of which is incorporated herein by reference.

FIELD

The present disclosure relates to a noise reduction insert for an evaporator.

BACKGROUND

This section provides background information related to the present disclosure, which is not necessarily prior art.

Flow of refrigerant through an evaporator of an air conditioning system is often controlled by a thermal expansion valve (TXV) located within a TXV housing. The TXV meters flow of refrigerant to the evaporator based on temperature of the refrigerant that has passed through the evaporator, as sensed by a sensor bulb. TXVs are typically located in close proximity to the evaporator for the best possible air-conditioning performance. To facilitate servicing, TXVs are also typically located at a vehicle dash-wall, and coupled to the evaporator with metal tubes.

When the air conditioning is initially activated, due to lack of sufficient sub-cooling, gaseous or gas/liquid refrigerant at high pressure passes through a small orifice of the TXV resulting in high velocity refrigerant that readily excites the acoustical cavity modes and circular/cylindrical higher order modes of refrigerant system components, which results in undesirable noises being produced, such as transient/audible hiss and gurgle. With existing TXVs, heavy damping material layers are applied to the TXV, tubing, and evaporator in an attempt to suppress the undesirable noises. Application of these damping materials suppresses hiss and some compressor induced noises. However, use of damping materials often undesirably results in amplification of transient gurgle when the air conditioning is turned on, and after the air conditioning has been turned off. Use of damping materials is thus undesirable because they can add cost and weight, are difficult to apply consistently, and induce and/or amplify gurgle noises. It would therefore be desirable to provide an improved device and system for suppressing undesirable gurgle that may occur when an air conditioning system is initially activated. The present teachings address these needs, as well as numerous others, and provide improvements over the art.

SUMMARY

This section provides a general summary of the disclosure, and is not a comprehensive disclosure of its full scope or all of its features.

The present teachings provide for a noise reduction insert for an evaporator. The noise reduction insert includes a body defining an inner volume of the insert. The body extends along a longitudinal axis of the insert. A perforated portion of the body defines a plurality of openings configured to allow fluid to pass out from within the inner volume through the plurality of openings. A flange at a first end of the body is opposite to a second end of the body. The flange defines an aperture through which the longitudinal axis extends. The aperture is configured to permit fluid to flow therethrough and into the inner volume defined by the body.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
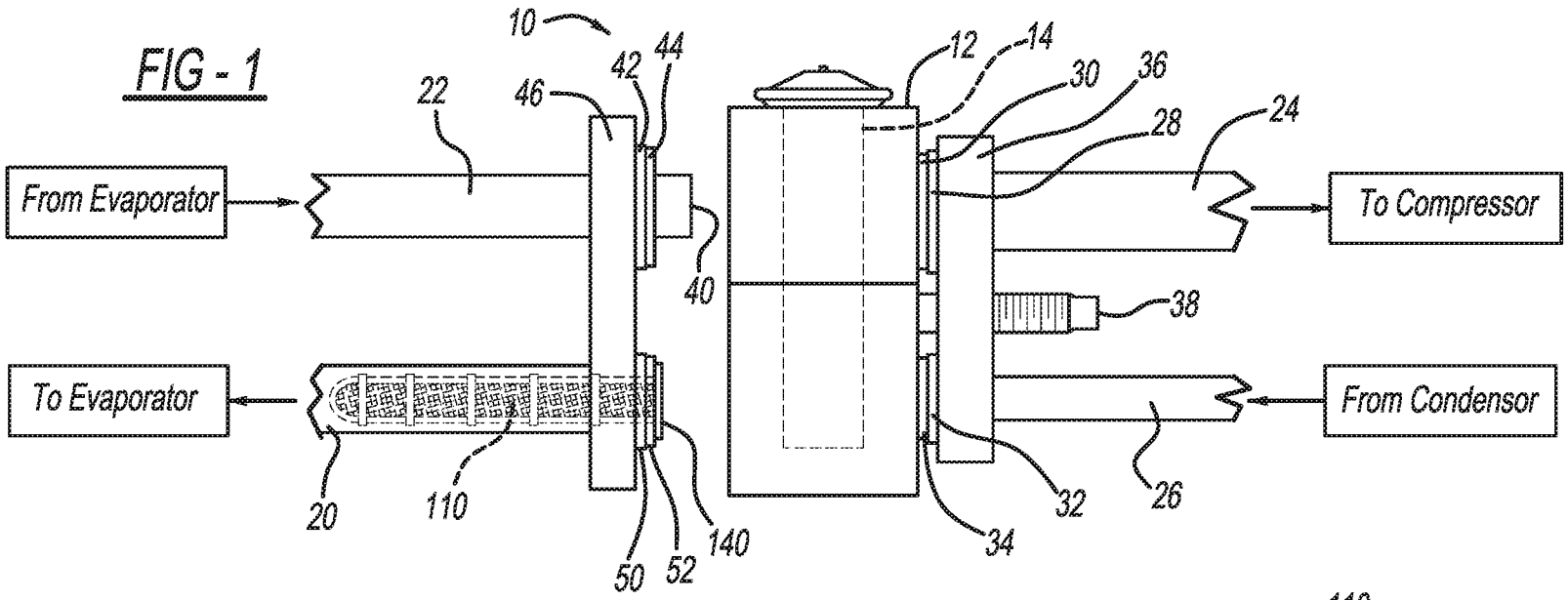
FIG. 1 is a TXV assembly including a noise reduction insert according to the present teachings seated in an output line extending from a TXV housing to an evaporator.

With initial reference to FIG. 1, a thermal expansion valve (TXV) assembly according to the present teachings is illustrated at reference numeral 10. The TXV assembly 10 includes a TXV housing 12 with a TXV 14 arranged therein. The TXV 14 meters flow of refrigerant to an evaporator of a heating, ventilation, and air conditioning (HVAC) system, such as a vehicle or building HVAC system. The HVAC system can be suitable for use in any vehicle, building, or other structure. For example, the HVAC system can be an HVAC system of an automobile, military vehicle, mass transit vehicle, watercraft, aircraft, or any suitable structure, such as a home, office building, stadium, etc.

The TXV housing 12 includes a first side, which is an evaporator side, and a second side, which is a compressor/ condenser side. The TXV housing 12 is connected to the evaporator at the first side with a first output line 20 and a first input line 22. At the second side, a second output line 24 connects the TXV housing 12 to a compressor, and a second input line 26 connects the TXV housing 12 to a condenser. The second output and input lines 24 and 26 are connected to the TXV housing 12 in any suitable manner, such as with a connection block 36. The block 36 is fastened to the TXV housing 12 with any suitable fastener, such as with fastener 38.

The second output line 24 includes a flange 28, which is held against the TXV housing 12 with the block 36. A washer 30 is positioned between the flange 28 and the TXV housing 12. Similarly, the second input line 26 includes a flange 32, which is held against the TXV housing 12 by the block 36. A washer 34 is arranged between the flange 32 and the TXV housing 12.

The first input line 22 includes a terminal end 40, which is received within the TXV housing 12. A first input line flange 42 of the first input line 22 is proximate to the terminal end 40. A seal 44 is seated over the first input line 22, and against the first input line flange 42 between the first input line flange 42 and the terminal end 40. A block 46 holds the first input line 22 in connection with the TXV housing 12, and specifically presses the seal 44 against the TXV housing 12. The block 46 can be secured to the TXV housing 12 in any suitable manner, such as with any suitable fastener.

The first output line 20 includes a first output line flange 50. A seal 52 is seated on the first output line 20 against the first output line flange 50. The seal 52 is held against the TXV housing 12 by the block 46 when the block 46 is secured to the TXV housing 12. Seated within the first output line 20 is a noise reduction insert 110 according to the present teachings.

Figure 2B:
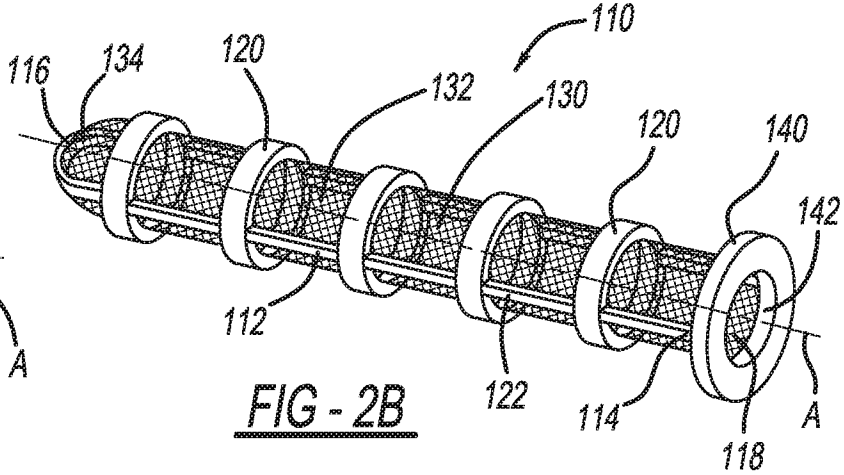
FIG. 2B is a perspective view of the noise reduction insert of FIG. 1.
Figure 2A:
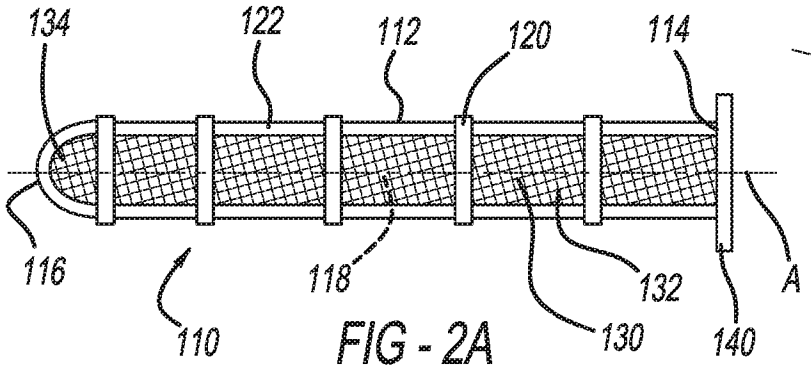
FIG. 2A is a side view of the noise reduction insert of FIG. 1.

With continued reference to FIG. 1 and additional reference to FIGS. 2A and 2B, the insert 110 generally includes a body 112 having a first end 114 and a second or distal end 116. The body 112 extends along a longitudinal axis A of the insert 110, which extends from the first end 114 to the second end 116. The body 112 defines an inner volume 118 of the insert 110. As illustrated, the body 112 is round, and thus continuously curves around the longitudinal axis A. The body 112 can have any other suitable shape, however.

The body 112 further includes ribs 120 and spine 122. The ribs 120 are spaced apart along the length of the body 112, and thus spaced apart along the longitudinal axis A. The ribs 120 are connected by the spine 122. The spine 122 can be configured in any suitable manner in order to support the ribs 120. For example and as illustrated, the spine 122 can extend from the first end 114 to the distal end 116, and then back to the first end 114. At the second end 116, the spine 122 can curve to provide the second end 116 with a rounded or cone-shaped end. The ribs 120 and the spine 122 can be made of any suitable material, such as any suitable polymeric or metallic material.

The body 112 further includes a mesh 130, which is arranged between the ribs 120 and the portions of the spine 122. The mesh 130 defines a plurality of openings 132 through which material, such as refrigerant, can pass through in order to flow out from within the insert 110 to the evaporator. The mesh 130 can be made of any suitable material, such as any suitable plastic, metallic, or nylon material. At the second end 116, the mesh 130 is formed as a rounded or cone-shaped end 134. The cone-shaped end 134 of the mesh 130 provides the insert 110 with an increased surface area as compared to a planar distal end. For example, the cone-shaped portion 134 can increase the surface area of the second end 116 of the insert 110 1.5 times greater than a planar distal end. As a result, there is a greater surface area for fluid, such as refrigerant, to flow out from within the inner volume 118 of the insert 110. This allows refrigerant to flow through the first output line 20 more freely, thus reducing the pressure of the refrigerant within the first output line 20 and reducing undesirable noise, such as gurgle.

The insert 110 further includes a flange 140 at the first end 114. With particular reference to FIG. 2B, the flange 140 is generally annular and defines an aperture 142. The longitudinal axis A extends through the aperture 142 at generally a radial center thereof. The aperture 142 provides access to the inner volume 118 of the insert 110.

As illustrated in FIG. 1, the insert 110 is positioned such that the flange 140 is outside of the first output line 20, and the body 112 extends into the first output line 20 towards, and in some instances into, the evaporator. The body 112 has a maximum outer diameter that is less than an inner diameter of the first output line 20 so as to allow the body 112 to be seated within the first output line 20. To prevent the insert 110 from sliding through the first output line 20 towards the evaporator, the flange 140 has a maximum outer diameter that is greater than an inner diameter of the first output line 20.

With the insert 110 seated in the first output line 20, refrigerant exiting the TXV housing 12 flows through the aperture 142 of the flange 140, and into the inner volume 118 defined by the body 112. The refrigerant then exits the body 112 through the mesh 130, and flows through the first output line 20 into the evaporator. Without the insert 110, modal frequencies may be generated at 2,710 hz, 3,082 hz, 3,357 hz, and 4,866 hz, which may result in undesirable gurgling noises being generated. These frequencies depend on the physical dimensions of the refrigerant system components and refrigerant temperature and pressure. However, when the insert 110 is seated in the first output line 20 as illustrated in FIG. 1, these modal frequencies are prevented from being induced or excited. For example, the insert 110 reduces the velocity and pressure of the refrigerant traveling through the first output line 20 to the evaporator, which prevents the acoustical cavity modes and circular/cylindrical higher order modes from being excited, which in turn suppresses or eliminates any undesirable gurgle.

The insert 110 illustrated in FIGS. 1, 2A, and 2B is an exemplary insert according to the present teachings. The present teachings further provide for numerous other insert configurations, such as those illustrated in FIGS. 3-13, which will now be described. The inserts of FIGS. 3-13 include many features in common with the insert 110, and thus similar features are illustrated with like reference numerals, but increased by orders of magnitude of 100. With respect to at least the common features, the description of the insert 110 also applies to the inserts of FIGS. 3-13. The inserts of FIGS. 3-13 are arranged in the TXV assembly 10, and specifically the first output line 20, in the same manner that the insert 110 is in the example described above. The inserts of FIGS. 3-13 generally provide the same or similar advantages that the insert 110 does. Specifically, the inserts of FIGS. 3-13 reduce the pressure and velocity of fluid, such as refrigerant, flowing through the first output line 20, thus advantageously reducing unwanted noises, such as gurgle.

Figure 3:
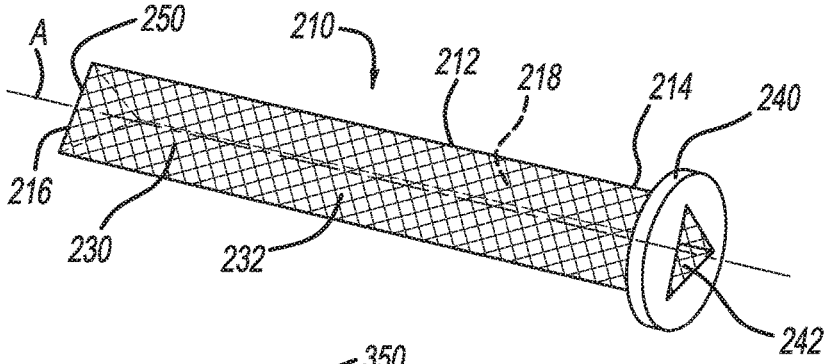
FIG. 3 is a perspective view of another noise reduction insert according to the present teachings.

With reference to FIG. 3, an additional insert according to the present teachings is illustrated at reference numeral 210. The insert 210 is similar to the insert 110, except that the body 212 of the insert 210 is not round, as the body 112 of the insert 110 is. The body 212 of the insert 210 is generally shaped as a triangle, and thus includes three generally planar surfaces 250 arranged to provide the body 212 with an overall triangular shape. Each one of the planar surfaces 250 includes mesh 230 and openings 232 defined by the mesh 230. The aperture 242 defined by the flange 240 also has a triangular shape. The distal end 216 can be solid or include the mesh 230, as is the case with all of the other inserts according to the present teachings.

Figure 4:
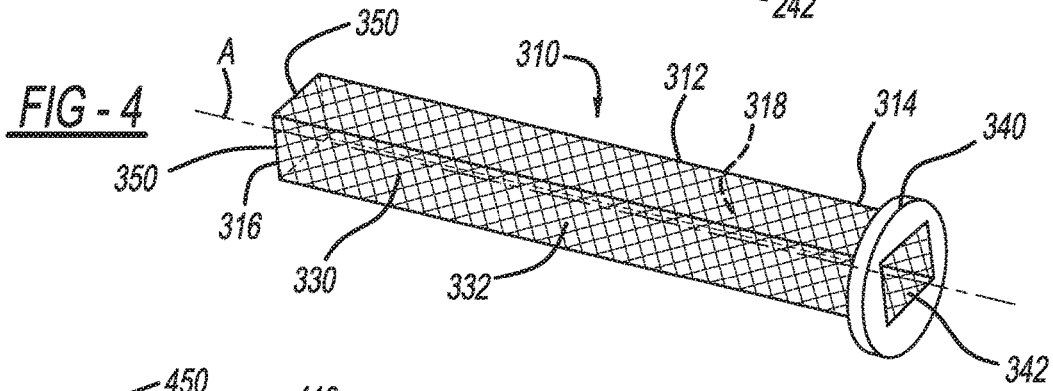
FIG. 4 is a perspective view of an additional noise reduction insert according to the present teachings.

FIG. 4 illustrates another insert according to the present teachings at reference numeral 310. The body 312 of the insert 310 has a generally square shape. Specifically, the insert 310 includes four generally planar surfaces 350 arranged at right angles to one another to provide a square body 312. Each one of the planar surfaces 350 includes mesh 330 and openings 332 defined by the mesh 330. The flange 340 defines an aperture 342 that is also square. The distal end 316 can be solid or include the mesh 330. Each one of the planar surfaces 350 includes the mesh 330.

Figure 5:
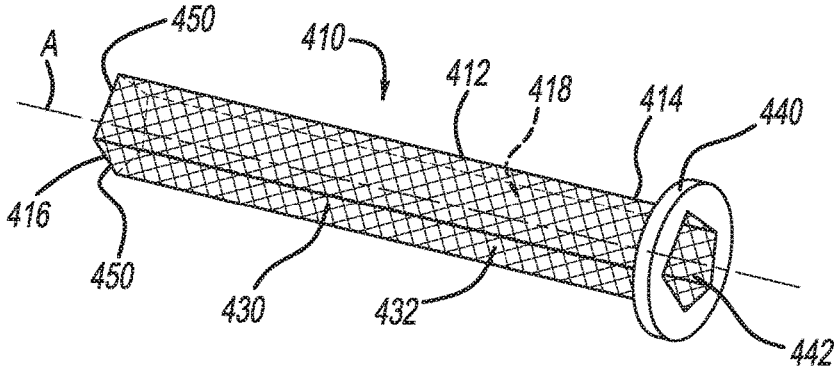
FIG. 5 is a perspective view of yet another noise reduction insert according to the present teachings.

With reference to FIG. 5, an additional insert according to the present teachings is illustrated at reference numeral 410. The body 412 of the insert 410 includes five planar surfaces 450, which are arranged to provide the body 412 with a pentagonal shape. Each one of the planar surfaces 450 includes the mesh 430 defining openings 432. Flange 440 defines aperture 442, which is also shaped as a pentagon. Distal end 416 may be closed, or may include the mesh 430.

Figure 6:
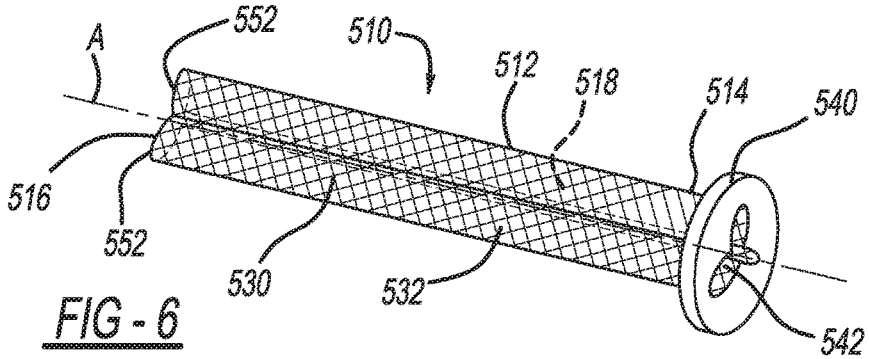
FIG. 6 is a perspective view of still another noise reduction insert according to the present teachings.

FIG. 6 illustrates another insert according to the present teachings at reference numeral 510. The body 512 of the insert 510 includes a plurality of surfaces 552, which may be curved or generally planar. Each one of the surfaces 552 includes mesh 530 and openings 532 defined by the mesh 530. Six of the surfaces 552 are included, each one of which includes mesh 530. The distal end 516 may be blocked or include the mesh 530.

Figure 7:
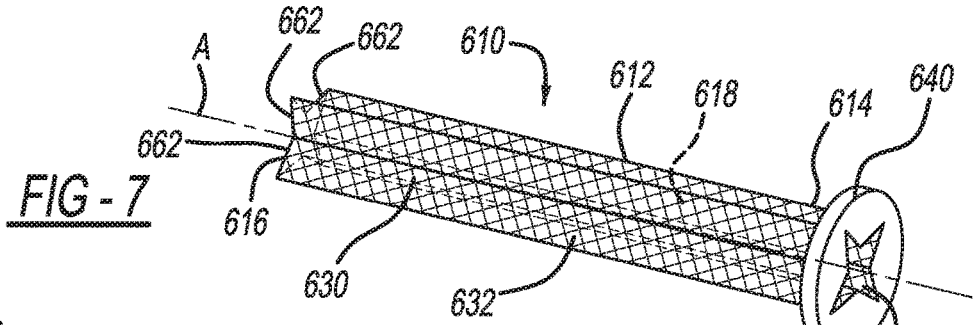
FIG. 7 is a perspective view of another noise reduction insert according to the present teachings.

FIG. 7 illustrates another insert according to the present teachings at reference numeral 610. The body 612 of the insert 610 includes eight surfaces 662, which may be planar or rounded. Each one of the surfaces 662 includes mesh 630 defining openings 632. The surfaces 662 extend to the flange 640, and provide the aperture 642 with six surfaces arranged to give the aperture 642 a star shape. The distal end 616 may include the mesh 630, or be a closed end.

Figure 8:
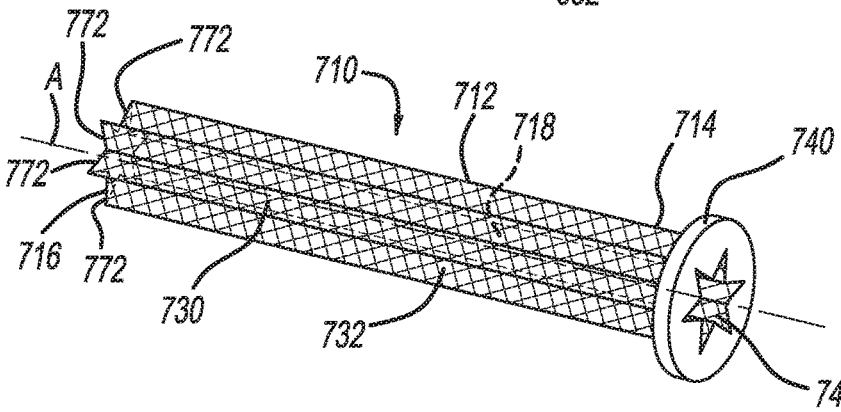
FIG. 8 is a perspective view of still another noise reduction insert according to the present teachings.

With reference to FIG. 8, another insert according to the present teachings is illustrated at reference numeral 710. The body 712 of the insert 710 includes 12 surfaces 772, which are arranged to provide the body 712 with a star shape in cross-section, such as a twelve-pointed star. The surfaces 772 each include the mesh 730 and extend to the flange 740. The aperture 742 of the flange 740 is also shaped as a twelve-pointed star. The distal end 716 may include the mesh 730, or be a closed end.

Figure 9:
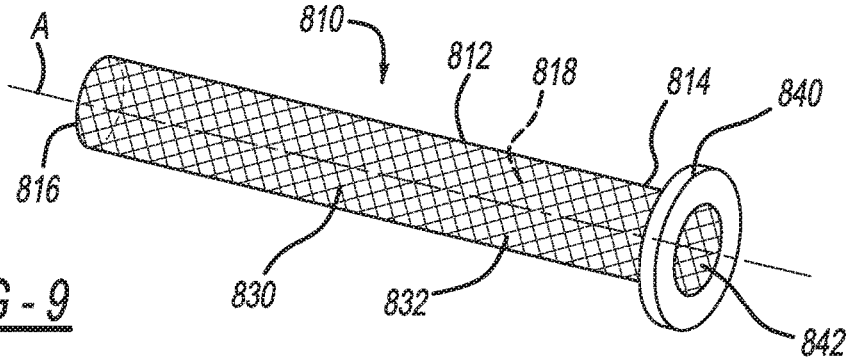
FIG. 9 is a perspective view of another noise reduction insert according to the present teachings.

FIG. 9 illustrates another insert according to the present teachings at reference numeral 810. The body 812 of the insert 810 is round in cross-section and has an outer diameter that is smaller than an inner diameter of the first output line 20. The mesh 830 defining the openings 832 extends along the length of the body 812 and to the flange 840. The aperture 842 at the flange 840 is circular. The mesh 830 may also be included at the distal end 816, or the distal end 816 may be closed.

Figure 10:
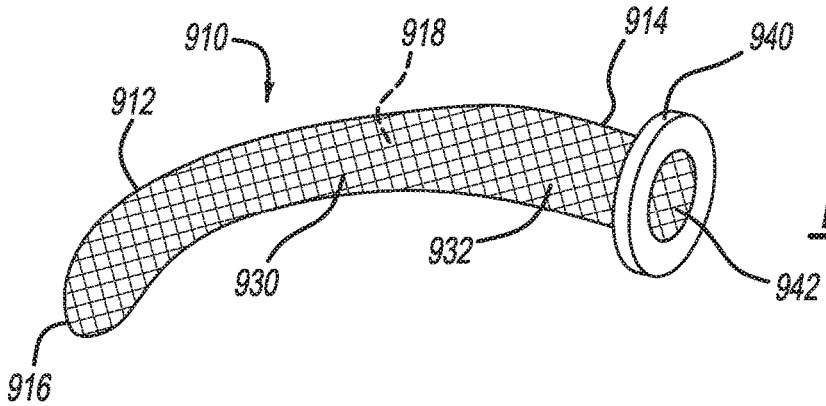
FIG. 10 is a perspective view of an additional noise reduction insert according to the present teachings.

With reference to FIG. 10, another insert according to the present teachings is illustrated at reference numeral 910. The body 912 of the inert 910 is flexible, and includes mesh 930 defining openings 932. Distal end 916 can be generally rounded or conical, and may be closed or include the mesh 930. The aperture 942 at the flange 940 is circular.

Figure 11:
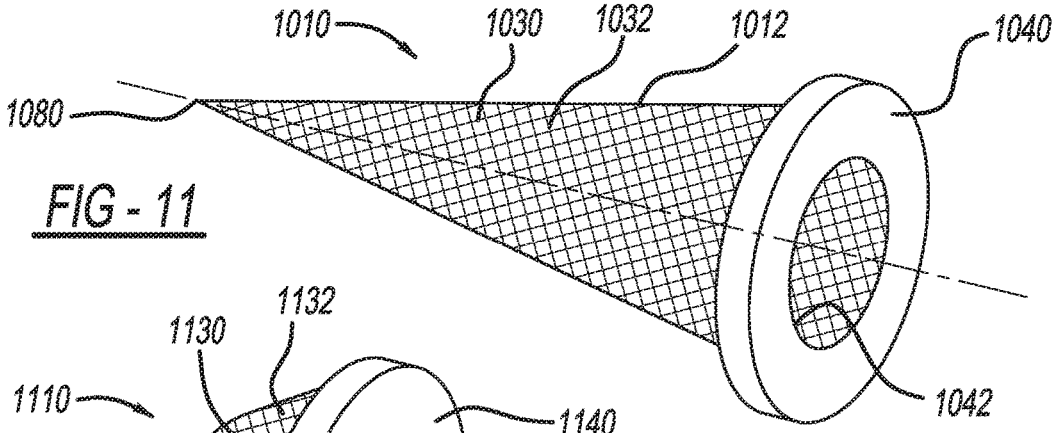
FIG. 11 is a perspective view of another noise reduction insert according to the present teachings.

FIG. 11 illustrates another noise reduction insert according to the present teachings at reference numeral 1010. The body 1012 of the insert 1010 is cone-shaped. The body 1012 is sized such that the portion thereof with the greatest diameter is smaller than the inner diameter of the first output line 20. The mesh 1030 defining the openings 1032 extends along the length of the body 1012 between the flange 1040 and a tip 1080, which can be pointed as illustrated. The aperture 1042 of the flange 1040 is circular.

Figure 12:
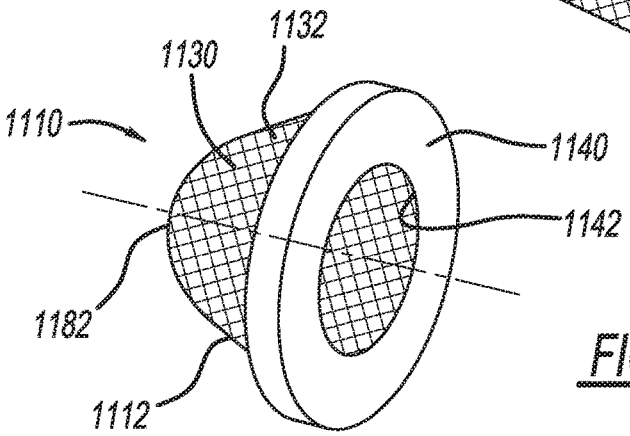
FIG. 12 is a perspective view of an additional noise reduction insert according to the present teachings.

FIG. 12 illustrates another noise reduction insert according to the present teachings at reference numeral 1110. The body 1112 of the insert 1110 is shaped as generally a rounded cone. The body 1112 is sized such that the portion thereof with the greatest diameter is smaller than the inner diameter of the first output line 20. The mesh 1130 defining the openings 1132 extends along the length of the body 1112 between the flange 1140 and a tip 1182, which is rounded. The aperture 1142 of the flange 1140 is circular.

Figure 13A:
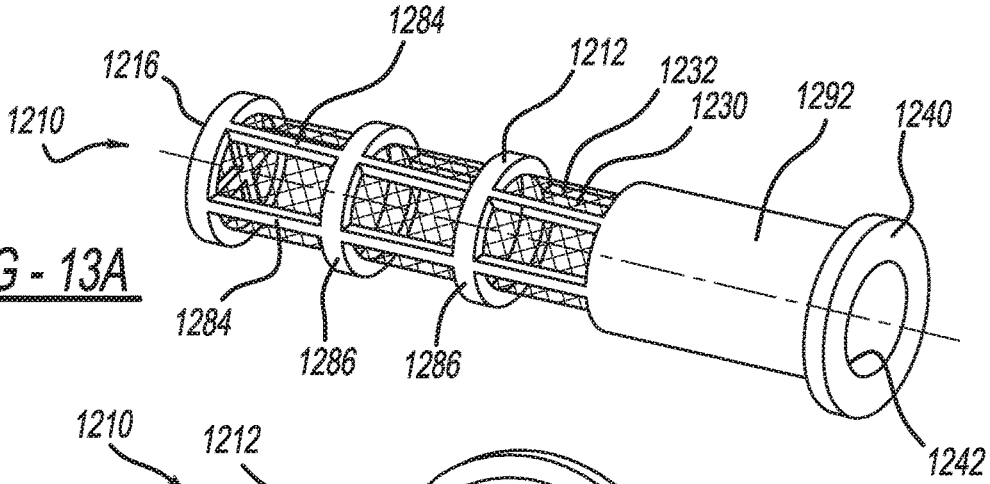
FIG. 13A is a perspective view of still another noise reduction insert according to the present teachings.
Figure 13B:
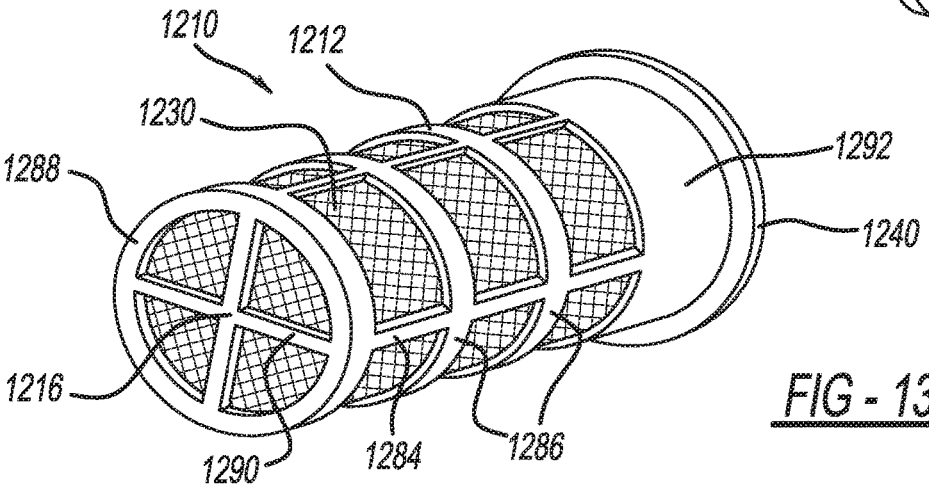
FIG. 13B is an additional perspective view of the noise reduction insert of FIG. 13A.

FIGS. 13A and 13B illustrate another noise reduction insert according to the present teachings at reference numeral 1210. The body 1212 of the insert 1210 is shaped to be generally cylindrical. The body 1212 is sized such that the portion thereof with the greatest diameter is smaller than the inner diameter of the first output line 20. The mesh 1230 is supported by a series of elongated rods 1284, which extend parallel to one another and to the longitudinal axis, and a number of cylindrical support members 1286, which are connected to the elongated rods 1284. The aperture 1242 at the flange 1240 is circular. At the distal end 1216 is a circular end piece 1288 with intersecting members 1290. Between the flange 1240 and the mesh 1230 is a solid portion 1292 of the body 1212, which is solid.

The description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). The term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A noise reduction insert for an evaporator comprising:

a body defining an inner volume of the insert, the body extending along a longitudinal axis of the insert;

a perforated portion of the body defining a plurality of openings configured to allow fluid to pass out from within the inner volume through the plurality of openings; and a flange at a first end of the body that is opposite to a second end of the body, the flange defining an aperture through which the longitudinal axis extends, the aperture is configured to permit fluid to flow therethrough and into the inner volume defined by the body; wherein the perforated portion includes mesh that is polymeric, metallic, or nylon, and the flange has an outer diameter that is greater than an inner diameter of a fluid line extending from a thermal expansion valve (TXV) housing to an evaporator to prevent the insert from passing through the fluid line.

2. The noise reduction insert of claim 1, wherein the body is round and continuously curves about the longitudinal axis, and the aperture is circular.

3. The noise reduction insert of claim 1, wherein the body has three planar surfaces each including the perforated portion, and the aperture is triangular.

4. The noise reduction insert of claim 1, wherein the body has four planar surfaces each including the perforated portion, and the aperture is square.

5. The noise reduction insert of claim 1, wherein the body has five planar surfaces each including the perforated portion, and the aperture has a pentagon shape.

6. The noise reduction insert of claim 1, wherein the body has six planar surfaces, each including the perforated portion.

7. The noise reduction insert of claim 1, wherein the body has eight planar surfaces, each including the perforated portion.

8. The noise reduction insert of claim 1, wherein the body has twelve planar surfaces, each including the perforated portion.

9. The noise reduction insert of claim 1, wherein the body is flexible.

10. The noise reduction insert of claim 1, wherein the second end is conical, and includes the perforated portion.

11. The noise reduction insert of claim 10, wherein the conical second end provides the second end with a surface that is at least 1.5 times greater than a planar second end.

12. The noise reduction insert of claim 1, wherein the second end is closed so as to restrict fluid flow therethrough.

13. The noise reduction insert of claim 1, wherein the body has an outer diameter that is less than the inner diameter of the fluid line extending from the thermal expansion valve (TXV) housing to the evaporator to permit the body to be inserted within the fluid line; and wherein fluid passing through the fluid line enters the body through the aperture, and exits the body through the plurality of openings defined by the perforated portion.

14. A noise reduction insert for an evaporator comprising:

a body defining an inner volume of the insert, the body extending along a longitudinal axis of the insert;

a perforated portion of the body defining a plurality of openings configured to allow fluid to pass out from within the inner volume through the plurality of openings; and a flange at a first end of the body that is opposite to a second end of the body, the flange defining an aperture through which the longitudinal axis extends, the aperture is configured to permit fluid to flow therethrough and into the inner volume defined by the body; wherein the body includes a plurality of spaced apart ribs connected by a spine extending parallel to the longitudinal axis, the perforated portion is between the ribs.

15. A thermal expansion valve (TXV) assembly comprising:

a TXV housing;

a first output line extending from the TXV housing to an evaporator;

a second output line extending from the TXV housing to a compressor;

a first input line extending from the TXV housing to an evaporator;

a second input line extending from the housing to a condenser;

a noise reduction insert seated within the first output line including:

a perforated body defining an inner volume of the insert, the body extending within the first output line along a longitudinal axis of the insert, the perforated body defines a plurality of openings through which refrigerant can flow, the perforated body has a maximum body outer diameter that is less than an inner diameter of the first output line to permit insertion of the body within the first output line; and a flange at a first end of the body that is opposite to a second end of the body, the flange defining an aperture through which the longitudinal axis extends, the aperture is configured to permit fluid to flow therethrough and into the inner volume defined by the body, the flange has a maximum flange outer diameter that is greater than the inner diameter of the first output line to prevent the insert from passing through the first output line.

16. The TXV assembly of claim 15, wherein the insert extends from the TXV housing to the evaporator.

17. The TXV assembly of claim 15, wherein:

the perforated body is round and continuously curves about the longitudinal axis;

the aperture is circular;

the second end is conical and is perforated; and the conical second end provides the second end with a surface area that is at least 1.5 times greater than a planar second end.

18. The TXV assembly of claim 15, wherein the perforated body includes a plurality of planar surfaces.

* * * * *